United States Patent [19]

Van Colen

[11] Patent Number: 4,826,093

[45] Date of Patent: May 2, 1989

[54] WINDING APPARATUS FOR ELONGATE ELEMENTS

[75] Inventor: Adelin Van Colen, Zwevegem, Belgium

[73] Assignee: N.V. Bekaert S.A., Zwevegem, Belgium

[21] Appl. No.: 119,917

[22] Filed: Nov. 13, 1987

[30] Foreign Application Priority Data

Dec. 24, 1986 [GB] United Kingdom ..... 8630914

[51] Int. Cl.[4] ..... B65H 54/00; B65H 59/00

[52] U.S. Cl. ..... 242/18 R; 242/45

[58] Field of Search ..... 242/18 R, 45, 75.5, 242/75.51

[56] References Cited

U.S. PATENT DOCUMENTS 2,459,064 1/1949 Davis ..... 242/45 X
3,193,209 7/1965 Hambach ..... 242/18 R

FOREIGN PATENT DOCUMENTS 3418286 5/1984 Fed. Rep. of Germany .
700197 2/1931 France .
1205162 9/1970 United Kingdom .

OTHER PUBLICATIONS

S. Noodleman, Torque Motors and Brakes, Product Engineering, Apr. 1957, 7 pages.

*Primary Examiner*—Stanley N. Gilreath
*Attorney, Agent, or Firm*—Foley & Lardner, Schwartz, Jeffery, Schwaab, Mack, Blumenthal & Evans

[57] ABSTRACT

Apparatus for winding at least one elongate element with a constant linear speed, such apparatus comprising a feeding mechanism 3, 4, 30, 31, 32 for said elongate element 1, a reel 6 and an induction motor 39 which drives said reel with a fixed gear ratio, the induction motor 39 having such a torque/rotational speed characteristic which is approximately equal to the torque/rotational speed characteristic necessary to obtain a constant tension in the elongate element. The torque/rotational speed characteristic for constant tension is obtained by control means 37 for adapting the frequency and the voltage magnitude of the drive signal for said induction motor. The feeding mechanism preferably comprises an electric motor 30, a transmission 31, 32 and a capstan 3. The control means preferably comprises an AC generator 37 which drives the induction motor and is rotated at a speed which is proportional to the rotation speed of the electric motor 30 of the feeding mechanism.

4 Claims, 2 Drawing Sheets

WINDING APPARATUS FOR ELONGATE ELEMENTS

BACKGROUND OF THE INVENTION

1. Field of the Invention

This invention relates to an apparatus for winding at least one elongate element onto a reel or bobbin so that the element has a constant linear speed. An elongate element can be regarded as one whose length is at least 10 times its cross-section and may comprise e.g. sheets, plastic foil, webs, cables, strands, wires, threads etc.

Reference is made herein to "winding-up apparatus" but this term is intended to encompass also apparatus which operate to unwind an elongate element from a reel or bobbin.

2. Related Art

It is often necessary or desirable to wind an elongate element with an appropriate tension which is as constant as possible. Wire, for example, wound onto a bobbin or reel under a tension which is too high can be damaged, whilst wire wound onto a bobbin or reel with a tension that is too low can cause problems when the wire is subsequently unwound.

In the British Patent Specification No. GB 1,205,162 it has already been shown that if the tension in an elongate element, which is fed to a reel or bobbin at a constant linear speed, is to be kept constant then the effective take-up torque $M_E$ exerted by the reel or bobbin must vary as a hyperbolic function in relation to its rotational speed. The required torque $M_M$ of the driving motor of the reel or bobbin is the sum of the effective take-up torque $M_E$ and of the friction torque $M_F$:

$$M_M = M_E + M_F$$

The value of the friction torque $M_F$ is smaller than the value of the effective torque $M_E$, i.e. $M_F$ is 10 to 50 per cent of $M_E$. This means that in order to obtain a constant tension in the elongate element the torque/rotational speed characteristic of the motor driving the reel must be approximate to $M_M$.

A winding apparatus generally comprises a feeding mechanism and a winding bobbin or reel. The feeding mechanism may comprise a motor and a capstan for feeding the elongate element at a constant linear speed.

The prior art provides several proposals for maintaining tension in the elongate element as constant as possible.

In one known winding apparatus, the tension in the elongate element is monitored by means of a "dancer" or feeler lever. If the tension varies, the dancer is pivoted and causes an appropriate correction to be applied to a mechanical or electrical speed control device. This is usually a potentiometer system adapted to change the speed of a DC-motor which drives the bobbin or reel. The "dancer system" gives an actual torque/rotational speed curve that is very close to the desired torque/rotational speed characteristic. The dancer system is, however, costly to install, and also expensive to maintain because of the DC-motor.

The above mentioned British Patent Specification No. GB 1,205,162 discloses a system intended to avoid this draw-back. The winding apparatus has an electrical drive for the reel or bobbin in the form of a capacitor motor having a capacitor of such capacity that the torque/rotational speed characteristic is approximately equal to the desired torque/rotational speed characteristic. This avoids the need for a costly closed-loop control system and the difficulties in the maintenance of DC-motors. However, the bobbin or reel is driven by the motor through a transmission having a constant gear ratio and therefore, if an elongate element has to be wound under a higher tension than a previous element, as is the case e.g. with a wire having a larger diameter than the previous wire, then the transmission is to be changed, i.e. geared "down", so that the reel or bobbin runs more slowly and more torque us applied. This gearing down (or up), i.e. adaptation of the fixed gear ratio, is necessary not only when another winding tension is required, but also when another linear delivery speed of the elongate element is required or when the dimensions of the bobbins or reels are changed. The adaptation of the fixed gear ratio is done mechanically and only when the winding apparatus is not in operation, e.g. by changing the gear ratio of a gear system or of a belt system. This operation is time-consuming and the arrangement cannot always provide the precise gear ratio required for the desired torque and linear speed concerned.

SUMMARY OF THE INVENTION

Viewed from one aspect the invention provides apparatus for winding an elongate element onto a reel, comprising means for feeding the element to the reel at a desired substantially constant linear speed of the element, and drive means for rotating the reel so that the elongate element is wound thereon under tension, wherein said drive means comprises an induction motor having a rotor resistance which provides a declining torque/rotational speed characteristic of the motor, and control means for regulating the frequency of the drive signal for the motor and for regulating either the voltage magnitude of the drive signal or the rotor resistance in such a way that the resultant torque/rotational speed characteristic of the motor at least approximates to that required to impart a desired, substantially constant tension to the elongate element as it is wound onto the reel for a given linear speed of the element.

The regulating means can control the voltage of the induction motor, or alternatively the rotor resistance of the induction motor. The latter may be the case if the induction motor is a slip ring armature motor.

The feeding mechanism preferably comprises a motor, a transmission system such as a belt or gear system, and a capstan that drives the elongate element at a constant linear speed. The motor of the feeding mechanism can be either a DC or an AC motor.

The induction motor for the reel can have a slip ring armature, but preferably comprises a short circuited rotor. In the case of a slip ring armature motor a suitable declining torque/rotational speed characteristic can be obtained by placing appropriate resistors at the slip ring. In the case of an induction motor with a short circuited rotor, the declining torque/rotational speed curve can be obtained by fabricating the rotor from appropriate material. This material must have a resistance which is greater than that of copper or aluminium, and cast iron, steel or steel alloys are therefore appropriate materials. Steel is preferable to cast iron because it is less expensive and because the rotor resistance of a steel rotor is easier to predict than the resistance of a rotor formed of cast iron.

The control means for regulating the frequency and voltage of the induction motor drive signal can comprise a static frequency regulator, but preferably comprises an AC generator. The electrical control possible in accordance with the invention is more accurate and quicker than the mechanical adaption of the fixed gear ratio as described in the above mentioned British Patent Specification No. GB 1,205,162.

The control means for regulating the voltage of the induction motor drive signal may comprise means for measuring the winding tension of the elongate element, and where the control means comprises an AC generator the exciting current of the AC generator is varied in accordance with such measured tension (it will be appreciated that variations in the exciting current of the AC generator result in variations in the output voltage thereof and thus in the drive voltage for the induction motor). In an alternative embodiment the control means may comprise a PLC (Programmable Logic Controller). The nature of the elongate element is fed into the PLC, which computes the appropriate tension and the exciting current for the AC generator is adjusted accordingly.

It will be appreciated that this invention is based partly on the recognition that once an approximate match or "best fit" has been achieved of the actual motor torque/rotational speed characteristic with that required to impart a particular constant tension to a longitudinal element for a particular linear delivery speed, other "best fit" torque/rotational speed characteristics can be obtained for different required tensions by appropriately varying the voltage magnitude of drive signal applied to the motor, or by varying its motor resistance, and/or for different linear delivery speeds of the element by appropriately varying the frequency of the drive signal.

It has been found in a preferred embodiment that other "best fit" torque/speed rotational characteristics of the induction motor for different linear speeds are automatically obtained if the frequency of the induction motor drive signal is controlled by an AC generator and if means are provided for rotating the speed of the AC generator at a speed which is proportional to the speed of an electric motor which drives the element feeding means. This means e.g. that once a "best fit" torque/rotational speed characteristic is obtained to wind a wire having a diameter D, one does not have to manually alter the torque/rotational speed characteristic to wind such wire at a different linear speed. The fixed speed of rotation ratio between the electrical motor for the feed mechanism and AC generator can easily be obtained by a gear or belt system.

The invention provides a winding apparatus, inexpensive in installation and maintenance, since no complex closed-loop control mechanism is required to keep the tension constant and because an induction motor drives the bobbin or reel instead of a DC motor and it is generally known that an induction motor requires less maintenance than a DC motor.

It will be appreciated that the invention extends to an apparatus for winding a plurality of elongate elements. In that case the feeding mechanism preferably comprises one electrical motor which drives a plurality of capstans for the respective elongate elements e.g. by means of a worm gear. Each elongate element is wound onto a bobbin or reel that is driven by its own respective induction motor. Thus there are as many bobbins or reels and induction motors as there are elongate members, in this embodiment.

BRIEF DESCRIPTION OF THE DRAWINGS

An embodiment of the invention will now be described, by way of example only, with reference to the accompanying drawings, wherein.

DETAILED DESCRIPTION OF THE PREFERRED EMBODIMENTS

Figure 1:
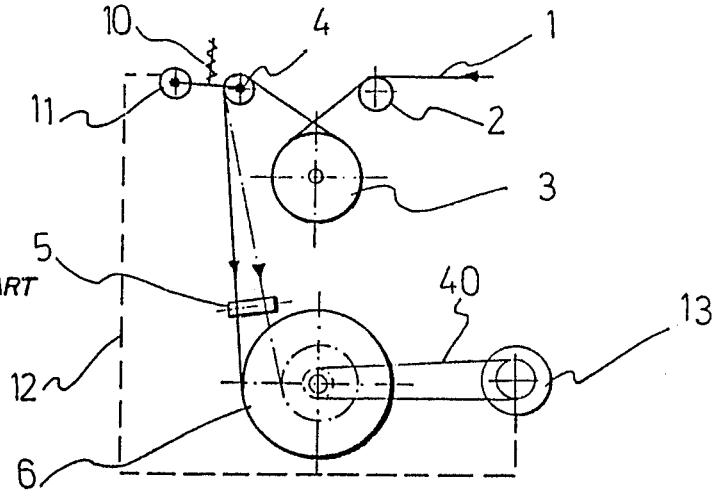
FIG.1 PRIOR ART
FIG. 1 is a diagrammatic view of a prior art dancer system.

FIG. 1 shows a prior art "dancer" system. An elongate element 1 is driven over guide pulley 2 by a capstan 3 to another guide pulley 4. The linear speed of the elongate element is constant. This linear speed is dependent on the up-stream installation which could be e.g. a wire drawing machine, a chemical or electrolytical pickling installation, a patenting installation, an electrolytic plating installation or a combination of several installations.

The elongate element 1 passes through a wire guide 5 and is wound on a bobbin or reel 6 with a constant tension. The appropriate tension is dependent on the nature of the elongate member. For example, for round steel wires with a diameter between 0.80 mm and 2.80 mm, the winding tension lies between 80 N and 220 N. The smaller diameters correspond to smaller tensions, whilst greater diameters correspond to greater tensions. The dancer system comprises a pivotable dancer 10, a potentiometer 11, and means 12 to adapt the revolution speed of a DC motor 13 which drives the bobbin or reel 6 by means of a belt 40. As used in hereinabove, the term "N" is the standard abbreviation of Newton which is the International System (IS) dimension for force. By definition 1 N=0.22481 lbf-pound force. The term "Nm" as used herein is the abbreviation of Newton meter and is the International System designation of torque. By definition 1 Nm=0.73757 lbf.ft.

Figure 2:
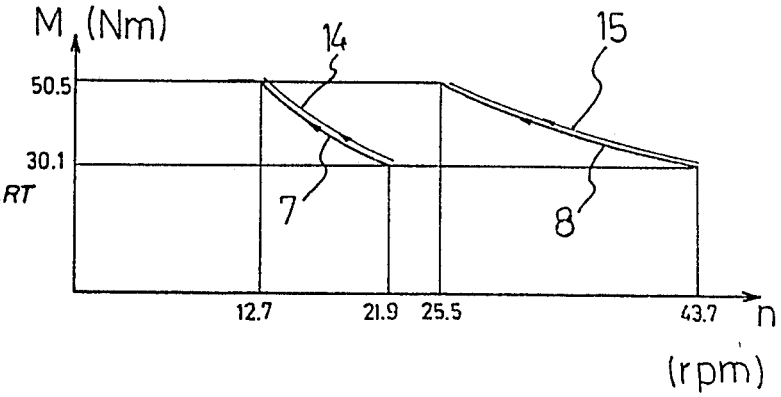
FIG.2 PRIOR ART
FIG. 2 shows the motor torque/rotational speed characteristic of a prior art dancer system.

In FIG. 2, curve 7 is a desired torque/rotational speed characteristic of the motor necessary to obtain a constant tension in the elongate element which is fed by the capstan 3 at a constant linear speed. At the beginning of the winding operation the effective winding diameter of the bobbin is small (e.g. 440 mm) and the required rotation speed of the bobbin or reel is therefore relatively high (e.g. 21.9 rpm).

At the end of the winding operation the winding diameter is higher (e.g. 750 mm) and the rotation speed of the bobbin or reel therefore reduces (e.g. 12.7 rpm). Likewise, it will be appreciated that as the effective winding diameter increases, then the torque applied by the motor must increase as shown to maintain a constant tension in the wire.

Curve 8 of FIG. 2 is also a motor torque/rotational speed characteristic necessary to obtain a constant tension in the elongate element where the constant linear speed of the element according to curve 8 (e.g. 60 m/min) is higher than the constant linear speed according to curve 7 (e.g. 30 m/min). Curves 14 and 15 are actual torque/rotational speed characteristics obtained by the dancer system and it will be seen that curves 14 and 15 are very close to curves 7 and 8, respectively.

Figure 3:
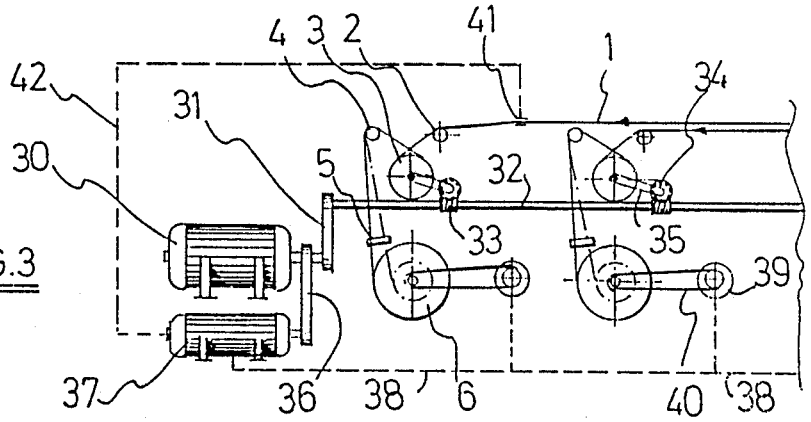
FIG. 3 is a side view of part of an apparatus in accordance to the invention.

An embodiment of an apparatus in accordance with the invention is shown in FIG. 3. Several elongate elements are driven over guide pulleys 2 by capstans 3 to other guide pulleys 4. The elongate elements 1 pass through wire guides 5 to bobbins or reels 6. An electric motor 30, which can be either a DC or an AC motor, drives the capstans 3 via a belt 31, a worm shaft 32, endless screw worms 33, worm wheels 34 and belts 35. The belts 35 can be omitted if the capstan 3 is mounted on a common axis with the the worm wheel 34. The electric motor 30 also drives an AC generator 37 via a belt 36. The AC generator 37 feeds (38) the induction motors 39 which drive, via belts 40, the bobbins or reels 6. The induction motors 39 have short circuited rotors formed of steel. A measuring element 41 measures the winding tension of the elongate element 1 and a connection 42 comprises means for adapting the drive current of the AC generator 37 in accordance with wire tension.

Figure 4:
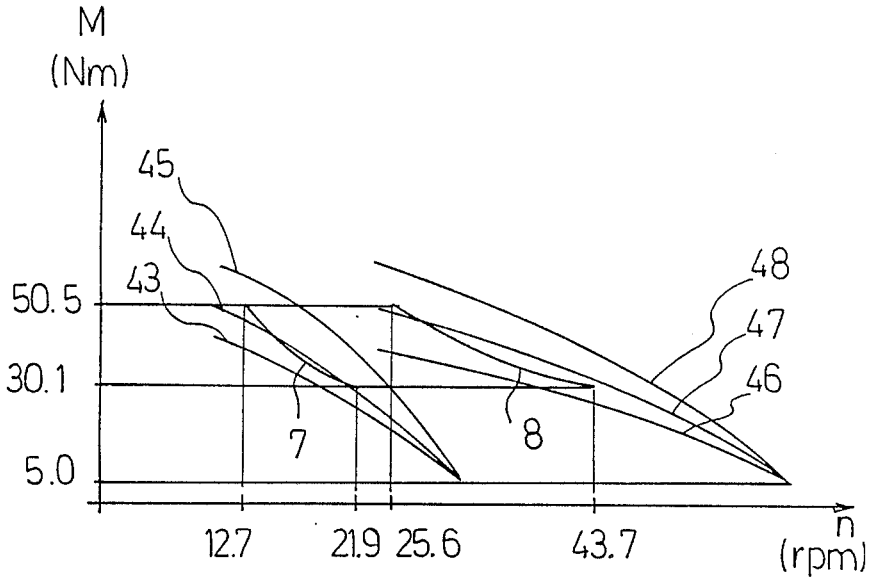
FIG. 4 shows torque/rotational speed characteristics of an apparatus in accordance with the invention

Curve 7 of FIG. 4 is a desired torque/rotational speed characteristic for the motor necessary to obtain a particular constant tension in the elongate element for a particular constant linear speed, in this example 30 m/min. Curve 8 of FIG. 4 is also a torque/rotational speed characteristic of the induction motor 39. The illustrated torque/rotational speed characteristics are those measured on the bobbin or reel 6 which means that one can deduce the actual torque/rotational speed characteristic of the induction motor 39 itself from curves 43 to 48 by multiplying the bobbin speed of rotation n by the fixed gear ratio between the bobbin or reel 6 and the induction motor 39, whilst dividing the torque M at the bobbin by the same fixed gear ratio.

Curves 43 to 45 all correspond to a frequency of the drive signal for the induction motor 39 of 30 Hz, whilst curve 43 corresponds to a drive signal voltage of 125 V, curve 44 to a voltage of 135 V and curve 45 to a voltage of 150 V.

Curves 46 to 48 all correspond to a frequency of the drive signal for the induction motor 39 of 60 Hz, whilst curve 46 corresponds to a drive signal voltage of 210 V, curve 47 to a drive signal voltage of 230 V, and curve 48 to a drive signal voltage of 250 V.

The working region for curves 43 to 45 goes from 21.9 rpm to 12.7 rpm. The working region for curves 46 to 48 goes from 43.7 rpm to 25.6 rpm.

As can be seen a good fit of actual and desired torque/rotational speed characteristics can be obtained by varying the frequency and the voltage of the drive signal for the induction motor for the reel. For curves 43 to 45 curve 44 is the "best fitting" torque/rotational speed characteristic. For the curves 46 to 48 curve 47 is the "best fitting" torque/rotational speed characteristic. It may be noted that the ratio of linear speeds for the two cases (first case : curves 7-43-44-45; second case : curves 8-46-47-48)

$$30 \text{ m/min} / 60 \text{ m/min} = \tfrac{1}{2}$$

is equal to the ratio of the drive voltage frequencies for the two cases.

$$30 \text{ Hz} / 60 \text{ Hz} = \tfrac{1}{2}.$$

This is a consequence of the fixed gear ratio 36 between the electric motor 30 of the feeding mechanism and the AC generator 37.

Where a different thickness of wire is used, the tension applied thereto during winding generally must be varied. This is achieved in the illustrated apparatus by an increase or decrease in the voltage magnitude of the drive signal applied to the induction motor consequent upon a change in the energising signal applied to the AC generator applied via means 41, 42. In this case, the desired curves for the torque/rotational speed characteristics exemplified by curves 7 and 8 in FIG. 4 would be shifted upwardly or downwardly, and the actual curve would be varied appropriately by adjusting the drive voltage magnitude to achieve an approximate match between the two.

The installation costs per capstan of an apparatus according to the example given in FIGS. 3 and 4 is about one half the costs of a conventional dancer-potentiometer system whilst the maintenance costs of the illustrated apparatus are about one third the maintenance costs of a conventional dancer-potentiometer system.

Modifications to the apparatus described and illustrated herein may be apparent to those of relevant skill which retain one or more of the advantages thereof. This disclosure is intended to encompass such modifications even if features presently forming the subject to the appended claims are omitted.

I claim:

1. An apparatus for winding an elongate element onto a reel, comprising:
   (a) feeding means for feeding an elongate element to a reel;
   (b) electric motor means for driving the feeding means to feed the elongate element to the reel at a desired, substantially constant linear speed;
   (c) an induction motor means for driving the reel and for winding the elongate element under tension;
   (d) a drive signal having a frequency and voltage magnitude fed to the induction motor means;
   (e) the induction motor means having a rotor resistance for providing a declining torque/rotational speed characteristic of the induction motor means;
   (f) an AC generator means having an exciting current controlling the magnitude of the frequency and voltage of the drive signal for imparting a desired, substantially constant tension to the elongated element wound on the reel for a given linear speed of the elongate element;
   (g) means for rotating the AC generator at a speed proportional to the rotational speed of the electric motor means; and
   (h) means for obtaining a fixed gear ratio between the electric motor means of the feeding means and the AC generator.

2. Apparatus as claimed in claim 1 wherein the elongate element is wire.

3. Apparatus as claimed in claim 2 wherein the diameter of the wire is up to 2.80 mm.

4. Apparatus as claimed in claim 3 wherein the diameter of the wire is between 0.80 and 1.70 mm.

* * * * *